US005728015A

United States Patent [19]

Patton et al.

[11] Patent Number: 5,728,015

[45] Date of Patent: Mar. 17, 1998

[54] BASKETBALL GOAL WITH EXPANDED RIM AND DRAIN HOLE

[76] Inventors: David L. Patton, 1943 W. 4550 South #D, Roy, Utah 84067; Nathaniel T. Smith, 5810 Main Point Blvd. #1, Ogden, Utah 84405

[21] Appl. No.: 661,973

[22] Filed: Jun. 12, 1996

[51] Int. Cl.[6] ..... A63B 63/08

[52] U.S. Cl. ..... 473/485

[58] Field of Search ..... 473/485–489, 473/481, 482, 100; 72/51, 52

[56] References Cited

U.S. PATENT DOCUMENTS

| | | | |
|---|---|---|---|
| 538,268 | 4/1895 | McCracken | 72/52 |
| 1,178,812 | 4/1916 | Lloyd | 72/52 |
| 1,520,196 | 12/1924 | Medart et al. | 473/485 |
| 1,547,378 | 7/1925 | Furtaw | 473/485 |
| 2,735,680 | 2/1956 | Ross | 473/485 |
| 3,194,555 | 7/1965 | Humphrey | 273/1.5 |
| 4,320,896 | 3/1982 | Engle et al. | 273/1.5 |
| 4,348,022 | 9/1982 | O'Donnell | 273/1.5 |
| 4,430,130 | 2/1984 | Sorensen | 473/482 X |
| 4,575,079 | 3/1986 | De Faveri | 273/1.5 |
| 4,583,732 | 4/1986 | Allen | 273/1.5 |
| 4,783,981 | 11/1988 | Shahum | 72/52 |
| 5,104,026 | 4/1992 | Sturrus et al. | 72/52 X |
| 5,305,998 | 4/1994 | Nesbit et al. | 473/481 |

OTHER PUBLICATIONS

Basketbakk Products International, Inc., Basketball Products International 95 96 Product Catalog, Front cover, Inside Front cover, pp. 4, 6, 7, 8 Jun. 11, 1995.

Huffy Sports Catalog, "Basketball's Hottest Products This Year," pp. 22–23.

Huffy Sports Catalog, "Our All–Star Lineup," pp. 22–23.

Lifetime Products Catalog, "Institutional Basketball Equipment Catalog," p. 8.

*Primary Examiner*—William H. Grieb

[57] ABSTRACT

A basketball goal for use in playing the game of basketball. The basketball goal includes a metal circular rim attached to a mounting bracket. The rim in configured with an inner rim perimeter with a diameter of about 18 inches and a centerline rim perimeter with a diameter of between about 18.5 inches and about 20 inches. A pair of support braces are disposed between the mounting bracket and the rim to support the rim. The basketball goal also includes net hooks for attaching a net to the rim.

17 Claims, 2 Drawing Sheets

BASKETBALL GOAL WITH EXPANDED RIM AND DRAIN HOLE

BACKGROUND

1. The Field of the Invention

The present invention is related to a basketball goal with an expanded rim. More particularly, the present invention is related to a basketball goal with a rim having a standard-sized inner diameter and an enlarged centerline diameter.

2. Technical Background

The sport of basketball has become increasing popular. Basketball standards are found in almost every neighborhood. Adjustable basketball standards allow people of all ages and sizes to participate in the sport of basketball. One important key to the enjoyment of the sport is safe, reliable equipment. A second key to the enjoyment of the sport is the ability of a player to make baskets.

Basketball goal systems are available with a variety of rim shapes and sizes. There are plastic basketball goals with over-sized rims for use on small basketball standards for toddlers. There are basketball goals consisting of a rim and suction cups that enable the goal to be attached to almost any smooth surface. There are also conventional basketball goals that are configured to meet specific standards set forth by high school, college, and professional basketball associations. These hoop assemblies have circular rims and are made of metal. The standard for the interior rim diameter recognized by these amateur and professional associations is 18 inches. These conventional rims, however, suffer certain disadvantages.

Many of these conventional rims are susceptible to bending over a period of time. Bent rims change the nature of the game and discourage play. The game of basketball is designed to be played with a rim that is parallel to the playing surface which allows basketballs shot from a variety of places about the playing surface to pass through the rim. Once a rim is bent, the angles and trajectories needed for a ball to pass through the rim change as does the nature of the game as it was intended to be played. Bent rims discourage play and can be relatively costly to replace. Thus it would be an advantage over conventional goals to have a goal which is less susceptible to bending.

With the advent of rims that can be adjusted to a variety of heights, the situation often arises when a player desires to suspend himself above the playing surface by hanging onto the rim. Although not advisable, hanging on the rim is sometimes necessary when the area of playing surface where a player would likely land after jumping toward the rim is occupied by another player. To avoid collision, the jumping player may hang from the rim until that player finds a suitable area of the playing surface upon which to land. Because of the configuration of conventional rims it can be painful to grab onto such rims. Additionally, users of conventional rims may feel that hanging on the rim will deform the rim. These players may thus risk collision with another player rather than risk deforming the rim by suspending themselves from it. Thus, it would be an advantage over conventional goals to provide a goal which includes a rim that is stronger and more comfortable to grab onto so that a player may suspend himself from the rim when necessary.

Conventional rims are generally about one half of an inch thick and, depending on the height of the rim, require a lot of practice to consistently pass a basketball through the rim. Some players may become discouraged by the initial difficulty of making a basket and may give up playing the game.

Thus, it would be an advantage over conventional rims if the rim were configured to increase a player's shooting percentage, thereby increasing his confidence.

From the foregoing, it will be appreciated that it would be an advancement in the art to provide a basketball goal with a rim of increased strength that is less likely to bend under the rigors of basketball play. It would be an additional advantage to provide such a goal which included a rim that was safe and reliable to grab onto when necessary to avoid injury. It would be another advantage to provide such a goal that would increase the likelihood of passing a ball through the rim of the goal. It would be a further advantage if the basketball goal offered these advantages and included a rim which met the conventional interior rim diameter standard of 18 inches.

Such a basketball goal is disclosed and claimed herein.

BRIEF SUMMARY OF THE INVENTION

The present invention is directed to a novel basketball goal which includes an enlarged rim. The basketball goal of the present invention includes a mounting bracket with metal circular rim attached to the mounting bracket. A pair of support braces are attached to the rim and to the mounting bracket to help maintain the rim in a substantially level position when the basketball goal is positioned for play. A number of net hooks are affixed to the rim to provide a place to attach a net to the rim.

The rim is formed by rolling steel into a tube and then connecting the ends of the tube into a circle. Thus, the circular rim of the present invention has a circular cross-section. This hollow rim configuration allows the rim to be larger without a substantial increase in weight. Rims formed by this process are also stronger. Thus, the hollow rim of the present invention has a larger cross-sectional diameter and is significantly stronger than conventional rims, but is only slightly heavier than conventional rims.

In one embodiment of the present invention, the rim is configured with a drain hole to allow fluid communication between the interior hollow of the rim and the ambient surroundings. Thus, any moisture within the rim can drain out. In a preferred embodiment, the rim is configured with three drain holes.

The rim is configured with an inner rim perimeter and a centerline rim perimeter. The inner rim perimeter defines the innermost edge of the circular rim and has a diameter of about 18 inches. The centerline rim perimeter runs along the apex or uppermost portion of the rim when the basketball goal is positioned for use. In one embodiment, the centerline rim perimeter has a diameter of between about 18.5 inches and about 20 inches and preferably about 19.25 inches. Thus, the basketball goal of the present invention is configured with an enlarged rim. The increased surface area of the rim allows pressure applied to a player's hands when the player is hanging onto the rim to be dispersed over a greater surface area of the player's hands. Because this pressure is not concentrated along a particular portion of the hand, the enlarged rim is easier and more comfortable to grasp.

The rim of the present invention has an annular rebound surface disposed between the inner rim perimeter and the centerline rim perimeter. The enlarged rim of the present invention creates a larger rebound surface than that of conventional rims. This larger rebound surface has the effect of directing more basketballs that bounce on the top portion of the rim inwardly, giving them a greater chance to pass through the rim. This effect increases the likelihood of a player scoring and generally results in a corresponding increase in the shooting confidence of the player. The enlarged rim also gives a player the illusion of a bigger target. This can also help a player's shooting confidence.

Thus, it is an advantage of the present invention to provide a basketball goal with a rim that is significantly stronger than conventional rims, but only slightly heavier. It is another advantage of the present invention to provide a basketball goal with an enlarged rim that is easier and more comfortable to grab onto when necessary. It is another advantage of the present invention to provide a basketball goal with a rim that has the illusion of a bigger target or larger goal, thus helping a player's shooting confidence. It is further advantage of the present invention to provide a basketball goal with a rim having a larger rebound surface to direct more basketballs inwardly. Finally, it is an advantage of the present invention to provide these basketball goal advantages while meeting the standard inner rim diameter of 18 inches.

These and other advantages of the present invention will become more fully apparent by examination of the following description of the preferred embodiments and the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
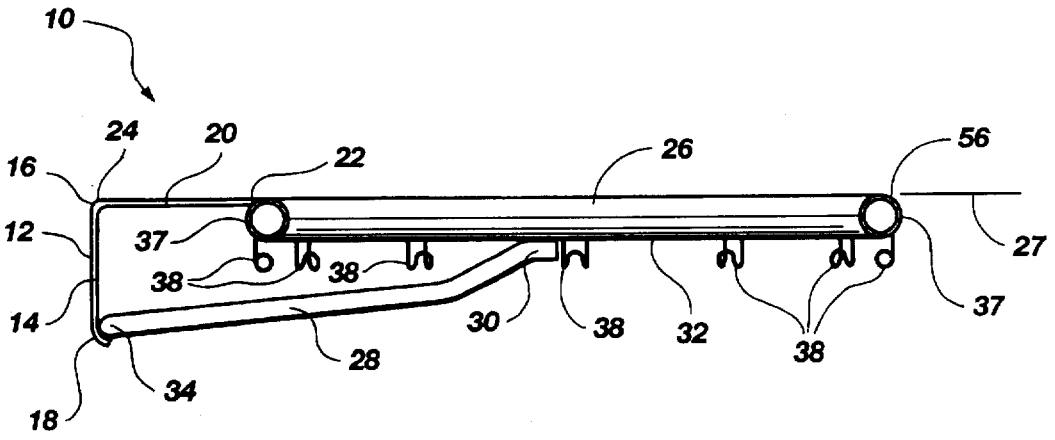
FIG. 1 is a side plan view of one embodiment of the basketball goal of the present invention.

Reference is now made to the figures wherein like parts are referred to by like numerals throughout. With particular reference to FIG. 1, a basketball goal according to the present invention is generally designated at 10.

The basketball goal 10 includes a mounting bracket 12 to allow the basketball goal 10 to be attached to a backboard, a pole, or another object to facilitate the play of basketball. The mounting bracket 12 is configured with a mounting plate 14 which includes a top edge 16 and a bottom edge 18. The mounting bracket 12 is also configured with a horizontal plate 20 which includes a front edge 22 and a back edge 24. The top edge 16 of the mounting plate 14 is attached to the back edge 24 of the horizontal plate 20 thereby permitting the mounting plate 14 is substantially perpendicular to the horizontal plate 20. In a presently preferred embodiment, the mounting bracket 12 is configured from a single, continuous piece of seven-gauge steel. This embodiment reduces the steps required to manufacture the mounting bracket 12 thereby decreasing the cost of manufacture.

A circular rim 26 is attached to the mounting bracket 12 adjacent the front edge 22 of the horizontal plate 20. In a presently preferred embodiment, the rim 26 is welded to the mounting bracket 12. The rim 26 is positioned in a plane 27 established by the horizontal plate 20. Thus, when the mounting plate 14 of the mounting bracket 12 is attached to a surface substantially perpendicular to a playing surface, the rim 26 will be substantially parallel to the playing surface. In a presently preferred embodiment, the rim 26 is attached to the mounting bracket 12 such that a center point 29 (FIG. 2) of the rim 26 is about fifteen inches from the mounting plate 14 of the mounting bracket 12. This distance conforms to the standard set for this dimension by the governing bodies for both amateur and professional basketball. The rim 26 of this preferred embodiment is made of fourteen-gauge steel.

Figure 2:
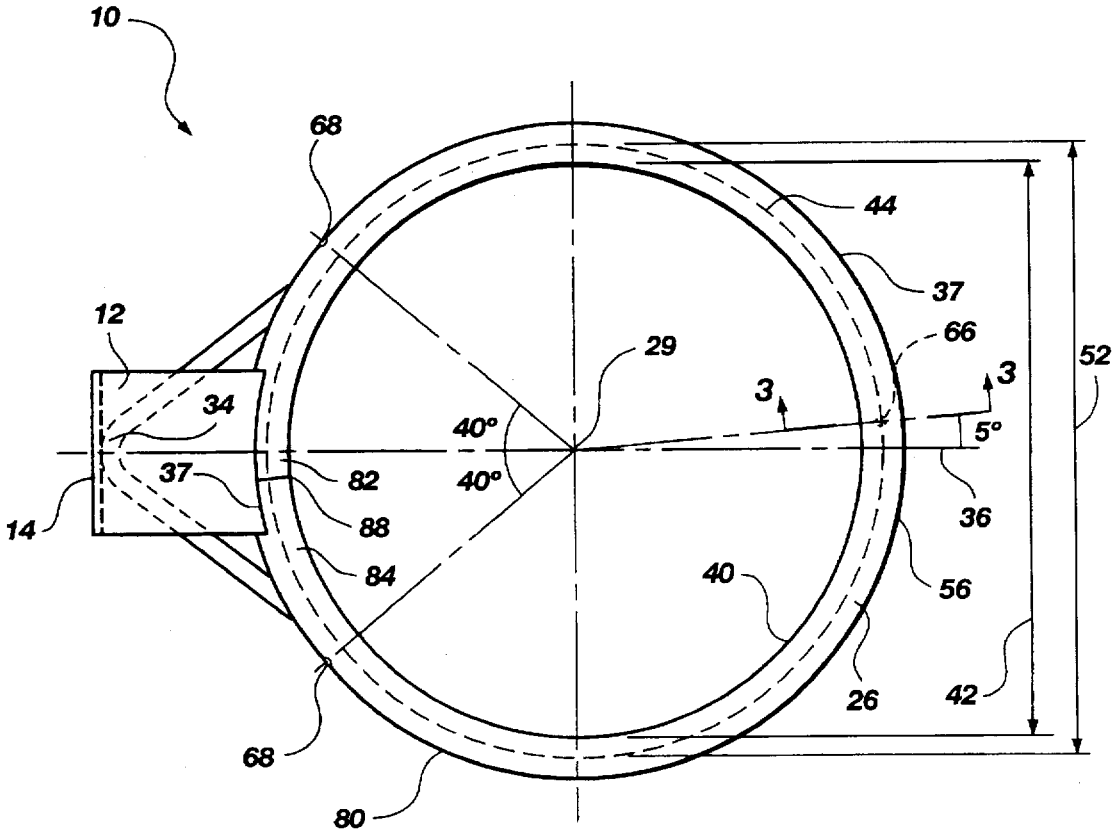
FIG. 2 is a top plan view the basketball goal of FIG. 1.

With continued reference to FIG. 1, a pair of support braces 28 are disposed between the rim 26 and the mounting bracket 12 to help maintain the rim 26 in a substantially horizontal position when the basketball goal 10 is positioned for basketball play. The basketball goal 10 is configured to be substantially symmetrical about a longitudinal axis 36 (FIG. 2). In one preferred embodiment, a first end 30 of each support brace 28 is attached to a bottom surface 32 of the rim 26 on opposite sides of the longitudinal axis. Similarly, a second end 34 of each support brace 28 is attached to the mounting plate 14 of the mounting bracket 12 adjacent the bottom edge 18 of the mounting plate 14. The support braces 28 are preferably welded to the rim 26 and the mounting bracket 12. In a presently preferred embodiment, the support braces 28 are configured from one continuous piece of metal such that each support brace 28 shares the same second end 34.

The support braces 28 are preferably configured with solid round bar supports that are one half inch in diameter. However, it will be appreciated by those of skill in the art that a variety of metals and other materials, including composite materials, can be used to form the rim of the present invention. It will also be appreciated by those of skill in the art that there are variety of ways to configure a mounting bracket 12 and to attach a mounting bracket 12 to a rim 26.

Referring still to FIG. 1, the present invention also includes a number of net hooks 38 affixed about the rim 26 for attaching a net (not shown) to the rim 26. In one embodiment, there are 12 net hooks 38 spaced about the rim 26. In a preferred embodiment, the 12 net hooks are equally spaced about the rim 26 and are welded to the rim 26 along the bottom surface 32 of the rim 26. In this configuration, the rim 26 of the present invention facilitates the attachment of a net meeting recognized net standards. In one presently preferred embodiment, two of the twelve equally spaced net hooks 38 are attached to the longitudinal axis 36 at opposite sides 37 of the rim.

Referring to FIG. 2, the rim 26 of the basketball goal 10 of the present invention is configured to define a circular inner rim perimeter 40 with a diameter 42 of about 18 inches. This inner rim diameter 42 meets the official inner rim diameter standard of 18 inches set for rims used in high school, college, and professional basketball play. The rim 26 also defines a circular centerline perimeter 44. The centerline perimeter 44 traces the center or apex of a top surface 46 of the rim 26. For example, as can best be seen by reference to FIG. 3, the cross-section of the rim 26 of the present invention is circular. The center of the top surface 46 of the rim 26 is the apex 48 of the arc 50 that defines the top half or surface 46 of the circular cross-section of the rim 26. The centerline perimeter 44 (FIG. 2) has a diameter 52 of between about 18.5 inches and about 20 inches and is preferably about 19.25 inches.

Figure 3:
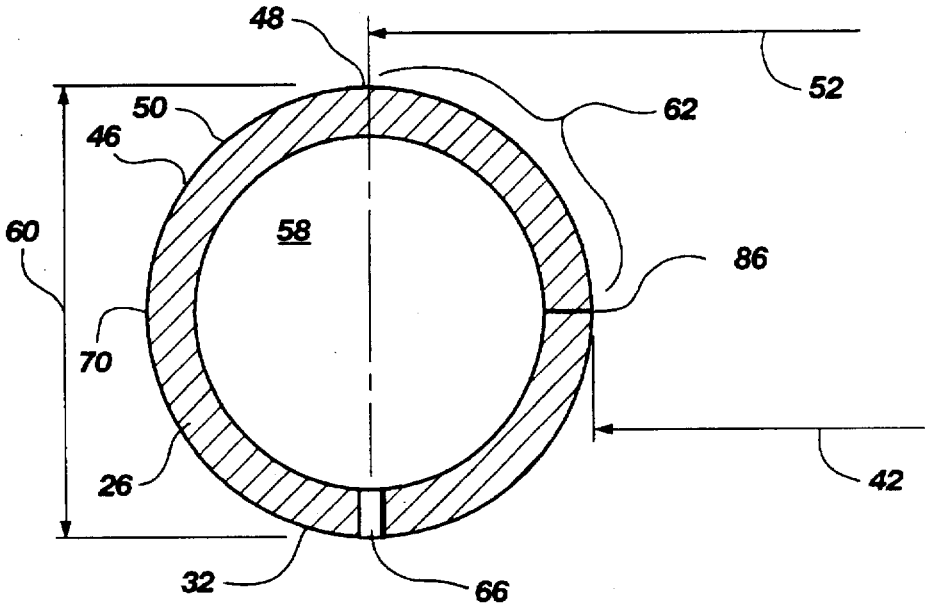
FIG. 3 is a cross-sectional view of the rim of the basketball goal of FIG. 2.

With continued reference to FIG. 3, rim 26 is configured with a hollow interior 58. This hollow configuration provides the rim 26 with greatly increased strength. In one preferred embodiment, the hollow rim 26 of the preferred invention can withstand over of 450 pounds of static force applied at a front portion 56 (FIG. 1) of the rim 26 before an unacceptable amount of plastic deformation occurs. This, is a significant improvement over conventional rims. The hollow rim 26 of the preferred invention can also withstand the dynamic forces resulting from upwards of 30,000 repetitions of a hundred pound object being dropped onto the front portion 56 of the rim 26 from a height of six inches. This is also a significant improvement over conventional rims. Both of these tests are designed to simulate the rigors of basketball play.

As illustrated in the circular cross-section of FIG. 3, the rim also defines a roll diameter 60. The roll diameter 60 is generally between about one inch and about four inches. In a presently preferred embodiment, the roll diameter 60 is about two and one-half inches.

The rim 26 is further configured with an annular rebound surface 62 disposed between the centerline perimeter and the inner rim perimeter along the top surface 46 of the rim 26 when the goal 10 is positioned for play. One of skill in the art will appreciate that the larger the roll diameter 60, the larger the rebound surface 62, and the larger the rebound surface 62, the higher the percentage of balls bouncing on the rim 26 that will pass through the goal. This result is due to increased percentage balls bouncing on the top surface 46 of the rim 26 that will be directed inwardly toward the goal. This may increase the confidence of a shooter and the enjoyment the shooter derives from the game.

The roll diameter 60 corresponds to a larger rim surface area which gives a player the illusion of shooting at a bigger target. This visual difference also increases the confidence of the shooter. The larger diameter surface also provides a more comfortable surface to grasp onto in the event a player must grasp the rim 26 during play. The pressure applied to a player's hands when hanging onto the rim 26 is dispersed over a greater surface area of the player's hands and is not concentrated along a particular portion of the hand.

With continued reference to FIG. 3, the hollow interior 58 is vented with at least one drain hole to thereby permit moisture within the hollow interior 58 to drain out of the rim 26. In a presently preferred embodiment, the rim 26 of the present invention is configured with three drain holes. A front drain hole 66 is disposed within the bottom surface 32 of the rim 26 adjacent the front portion 56 (FIG. 2) of the rim 26 when the basketball goal 10 is positioned for play. In this configuration, moisture from the elements is allowed to drain out of the bottom of the rim 26 and is not confined within the hollow interior 58 of the rim 26.

As illustrated in FIG. 2, the front drain hole 66 is disposed within the bottom surface 32 of the rim 26 about five degrees from the longitudinal axis 36 adjacent the front portion 56 of the rim 26. As will be more fully discussed below, the front drain hole 66 in this presently preferred embodiment is disposed within the rim 26 180 degrees from or directly opposite a vertical seam 88 created when forming the rim. It will be appreciated by those of skill in the art that the front drain hole 66 may be disposed at a variety of locations along the rim 26 and still allow moisture within the rim 26 to drain out.

Moisture may also enter the hollow interior 58 of the rim 26 during the manufacturing process. Thus, in one embodiment, at least one side drain hole 68 is configured within the rim 26 thereby permitting moisture to drain out of the rim at a specific point in the manufacturing process. In a presently preferred embodiment, a pair of side drain holes 68 are disposed within a side 70 of the rim 26 between the top surface 46 and the bottom surface 32 (FIG. 3). Each side drain hole 68 is disposed within the rim 26 adjacent the mounting bracket 12 about 40 degrees from, and on opposite sides of, the longitudinal axis 36 extending along the rim 26. In this configuration, the rim 26 may be hung by a net hook 38 on either side of the net hook 38 positioned adjacent the front portion 56 of the rim 26 on the longitudinal axis 36, and one of the side drain holes 68 will occupy a lowest point of the rim 26 allowing the force of gravity to direct any moisture within the rim 26 out of the drain holes 68. This configuration allows goal assemblies 10 to be hung for draining with the brackets 12 of adjacent hanging assemblies 10 offsetting, which minimizes the space used during this step in the manufacturing process.

One of skill in the art will appreciate that the side drain holes 68 can be disposed in a variety of positions about the rim 26 to allow moisture within the rim 26 to drain out of the rim 26.

Each drain hole of the rim of the present invention is between about 0.10 and about 0.26 inches in diameter, with a diameter of about 0.19 inches being presently preferred. It will be appreciated by those of skill in the art that in alternative embodiments the drain holes can be in a variety of sizes and configurations to allow moisture to drain out of the rim 26.

Figure 4:
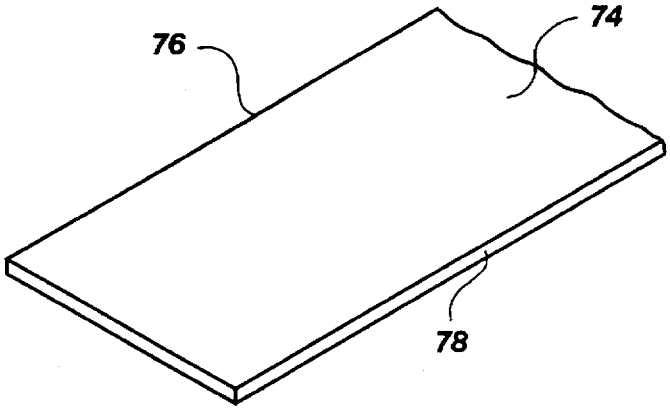
FIG. 4 is a perspective view a sheet of metal used to configure the rim of FIG. 1.
Figure 5:
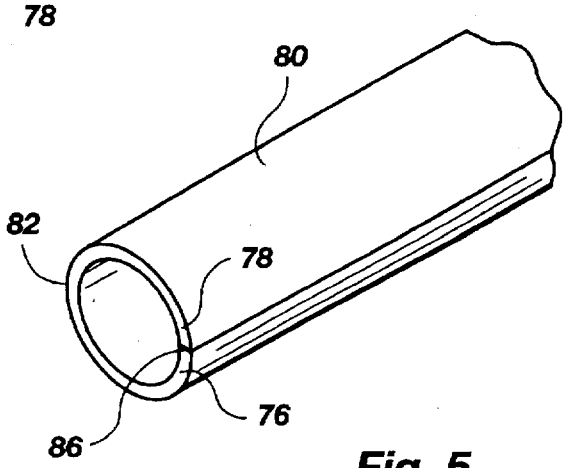
FIG. 5 is a perspective view of the sheet of metal shown in FIG. 4 after it has been rolled into a tube.

With reference now to FIGS. 4 and 5, the process of making the rim 26 of the present invention is shown. The rim 26 is configured by rolling a section of steel 74 such that a first longitudinal edge 76 of the section 74 is rolled to meet a second longitudinal edge 78 of the section 74 to thereby form a tube 80. In a presently preferred embodiment, the first longitudinal edge 76 and the second longitudinal edge 78 are welded together at various places along the tube 80. Thus, the tube 80 is configured with a first end 82 and a second end 84 (not shown) with a tube seam 86 running the length of the tube 80 between the first end 82 and the second end. It will be appreciated by those with skill in the art that first longitudinal edge 76 and the second longitudinal edge 78 may welded together along the entire length of the tube.

As illustrated in FIG. 2, the tube 80 is curved such that the first end 82 of the tube 80 meets the second end 84 of the tube 80 to thereby form the circular rim 26. The first end 82 of the tube 80 and the second end 84 of the tube 80 are welded together to form a rim seam 88. The rim 26 is attached to the bracket 12 such that the tube seam 86 is disposed within an inside surface of the rim 26 (FIG. 3) and the rim seam 88 is positioned such that when the rim 26 is attached to the mounting bracket 12 the rim seam 88 is adjacent to the front edge 22 of the horizontal plate 20. In one presently preferred embodiment, the rim seam 88 is disposed within the rim 26 180 degrees from the front drain hole 66 (FIG. 2). Thus, the seams 86 and 88 are positioned such that they are less likely to interfere with the bounce of a ball on the rim 26 when the basketball goal 10 is positioned for basketball play.

The net hooks 38 are then attached to the rim. In one presently preferred embodiment, the support braces 28 and the bracket 12 are secured to the rim 26 at the same time, although it will be appreciated by those of skill in the art that the assembly of the rim can be accomplished in a variety of ways.

The goal assembly 10 is then coated for a smooth finish. In this preferred embodiment, the rim is powdered-coated to thereby prevent against rusting. The powder coat substantially hides the tube seam 86. The goal assembly 10 is then washed and hung with the mounting brackets 12 in offsetting positions thereby allowing any water within the rim 26 to drain out of the drain holes 68 using a minimum of space.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A basketball goal for use in playing the game of basketball, comprising:

a mounting bracket;

a metal, circular rim attached to the mounting bracket, the rim having an inner rim perimeter with a diameter of about 18 inches and a centerline rim perimeter with a diameter of between about 18.5 inches and about 20 inches, the rim having a hollow interior with at least one drain hole having a diameter of between about 0.10 and about 0.26 inches;

a pair of support braces, each support brace disposed between the mounting bracket and the rim; and means for attaching a net to the rim.

2. The basketball goal of claim 1, wherein the diameter of the centerline perimeter of the rim is about 19.25 inches.

3. The basketball goal of claim 1, wherein the rim is configured with a substantially circular cross-section.

4. The basketball goal of claim 1, wherein at least one drain hole is disposed within a side portion of the rim when the goal is positioned for basketball play.

5. The basketball goal of claim 1, wherein the drain holes are about 0.19 inches in diameter.

6. The basketball goal of claim 1, wherein the means for attaching a net to the rim comprises a plurality of net hooks affixed to the rim.

7. The basketball goal of claim 1, wherein the rim is configured with 14 gauge steel.

8. A basketball goal for use in playing the game of basketball, comprising:

a mounting bracket;

a circular rim attached to the mounting bracket, the rim having an inner rim perimeter with a diameter of about 18 inches and a centerline rim perimeter with a diameter of between about 18.5 inches and about 20 inches, the rim having a circular cross-section with a hollow interior, the rim configured with at least one drain hole disposed within the rim to thereby permit moisture within the annular hollow interior to drain out of the rim, each drain hole having a diameter of between about 0.10 and about 0.26 inches;

a pair of support braces, each support brace disposed between the mounting bracket and the rim; and a plurality of net hooks affixed to the rim.

9. The basketball goal of claim 8, wherein the centerline diameter of the rim is about 19.25 inches.

10. The basketball goal of claim 8, wherein at least one drain hole is disposed within a side portion of the rim between a top surface and a bottom surface when the goal is positioned for basketball play, each hole disposed within the rim adjacent the mounting bracket.

11. The basketball goal of claim 8, wherein each drain hole is about 0.19 inches in diameter.

12. The basketball goal of claim 8, wherein the rim is configured by the process of rolling a section of 14 gauge steel such that a first longitudinal edge of the section of steel is rolled to meet a second longitudinal edge of the section of steel to thereby form a tube, the tube having a first end and a second end with a tube seam disposed therebetween, the tube is then curved into a circular rim such that the first end of the tube meets the second end of the tube to thereby form a rim seam.

13. The basketball goal of claim 12, wherein the tube seam is disposed within an inside surface of the rim when the goal is positioned for basketball play.

14. The basketball goal of claim 12, wherein the rim seam is disposed adjacent the mounting bracket.

15. A basketball goal for use in playing the game of basketball, comprising:

a mounting bracket;

a 14 gauge steel circular rim attached to the mounting bracket, the rim having an inner rim perimeter with a diameter of about 18 inches and a centerline rim perimeter with a diameter of about 19.25 inches, the rim having circular cross-section with a hollow interior, the rim configured with at least one drain hole disposed within the rim to thereby permit moisture within the annular interior hollow to drain out of the rim, each drain hole being between about 0.10 and about 0.26 inches in diameter;

a pair of support braces, each support brace disposed between the mounting bracket and the rim; and a plurality of net hooks affixed to the rim.

16. A basketball goal for use in playing the game of basketball, comprising:

a mounting bracket;

a metal, circular rim attached to the mounting bracket, the rim having an inner rim perimeter with a diameter of about 18 inches and a centerline rim perimeter with a diameter of between about 18.5 inches and about 20 inches, the rim also having a hollow interior with at least one drain hole disposed within a bottom portion of the rim when the goal is positioned for basketball play;

a pair of support braces, each support brace disposed between the mounting bracket and the rim; and means for attaching a net to the rim.

17. A basketball goal for use in playing the game of basketball, comprising:

a mounting bracket;

a circular rim attached to the mounting bracket, the rim having an inner rim perimeter with a diameter of about 18 inches and a centerline rim perimeter with a diameter of between about 18.5 inches and about 20 inches, the rim having a circular cross-section with a hollow interior, the rim configured with at least one drain hole disposed within the rim to thereby permit moisture within the annular hollow interior to drain out of the rim;

a longitudinal axis positioned such that the mounting bracket and circular rim are substantially symmetrical about a longitudinal axis and wherein at least one drain hole is disposed within the bottom surface of the rim adjacent a front portion of the rim about five degrees from the longitudinal axis;

a pair of support braces, each support brace disposed between the mounting bracket and the rim; and a plurality of net hooks affixed to the rim.

* * * * *